US009502167B1

(12) United States Patent
Gieras

(10) Patent No.: US 9,502,167 B1
(45) Date of Patent: Nov. 22, 2016

(54) HIGH TEMPERATURE ELECTROMAGNETIC ACTUATOR

(71) Applicant: Hamilton Sundstrand Corporation, Windsor Locks, CT (US)

(72) Inventor: Jacek F. Gieras, Glastonbury, CT (US)

(73) Assignee: HAMILTON SUNDSTRAND CORPORATION, Windsor Locks, CT (US)

( * ) Notice: Subject to any disclaimer, the term of this patent is extended or adjusted under 35 U.S.C. 154(b) by 0 days.

(21) Appl. No.: 14/945,022

(22) Filed: Nov. 18, 2015

(51) Int. Cl.

| | |
|---|---|
| ***H01F 1/01*** | (2006.01) |
| ***H01F 7/08*** | (2006.01) |
| ***H01F 5/06*** | (2006.01) |
| ***H01F 7/16*** | (2006.01) |
| ***H01F 41/02*** | (2006.01) |

(52) U.S. Cl.
CPC ..... *H01F 7/081* (2013.01); *H01F 1/01* (2013.01); *H01F 5/06* (2013.01); *H01F 7/1638* (2013.01); *H01F 41/02* (2013.01)

(58) Field of Classification Search
CPC ..... H01F 7/081; H01F 5/06; H01F 7/1683; H01F 1/01; H01F 41/02
See application file for complete search history.

(56) References Cited

U.S. PATENT DOCUMENTS

| | | | |
|---|---|---|---|
| 6,651,954 | B1 | 11/2003 | Porcher et al. |
| 6,685,882 | B2 | 2/2004 | Deevi et al. |
| 6,688,578 | B1 | 2/2004 | Nussio et al. |
| 6,925,803 | B2 | 8/2005 | Natali |
| 7,128,790 | B2 | 10/2006 | Waeckerle et al. |
| 9,057,115 | B2 | 6/2015 | Pieper et al. |
| 2014/0354381 | A1 | 12/2014 | Kohlhafer |
| 2015/0097130 | A1 | 4/2015 | Gieras et al. |

FOREIGN PATENT DOCUMENTS

| | | | |
|---|---|---|---|
| EP | 1680854 | A2 | 7/2006 |
| JP | 2003086415 | A | 3/2003 |
| KR | 1188135 | B1 | 10/2012 |
| WO | 2005043714 | A2 | 5/2005 |

OTHER PUBLICATIONS

Sidell, N., Jewell G.W..: Short-stroke, bidirectional linear actuator for high temperature applications, IEE Proceedings-Electric Power Applications, 2000—IET., 6 pages.
Sidell, N., Jewell, G.W.: The Design and Construction of a High Temperature Linear Electromagnetic Actuator. J. of Appl. Physics, vol. 85, No. 8, 1999, pp. 4901-4903, 3 pages.

*Primary Examiner* — Ramon M Barrera
(74) *Attorney, Agent, or Firm* — Cantor Colburn LLP

(57) ABSTRACT

An electromagnetic actuator includes a magnetic circuit that includes a stationary core having a first leg, a second leg and a connecting leg that connects the first and second legs, the stationary core being formed of a high temperature ferromagnetic material, and an armature formed of the high temperature ferromagnetic material. The actuator also includes one or more position returning members disposed between the stationary core and the armature and a first winding surrounding the first leg, the first winding being formed a metal wire with ceramic insulation.

14 Claims, 5 Drawing Sheets

HIGH TEMPERATURE ELECTROMAGNETIC ACTUATOR

BACKGROUND OF THE INVENTION

The subject matter disclosed herein relates to actuators and, in particular, to a high temperature electromagnetic actuator.

A linear actuator is an actuator that creates motion in a straight line, in contrast to the circular motion of a conventional electric motor. Linear actuators are used in machine tools and industrial machinery valves and dampers, and in many other places where linear motion is required. Further example applications included use in turbine engines, e.g., more electric engine (MEE) for aircraft, combustion engines for ship propulsion, and combustion engines for road vehicles. In turbine engines and combustion engines high temperature actuators can be used for valves for air and fuel distribution.

An electromagnetic actuator is an electromechanical energy conversion device, which converts the electrical energy into mechanical energy of short-distance linear motion.

There are several manners in which an actuator can be formed. One is to convert a rotary motion in to a linear motion. Another is to apply a current to a winding surrounding a permanent magnet. Application of a current causes the magnet to move and this motion, in turn, causes a plunger attached to the magnet to move and deliver linear motion.

In some cases, however, use a permanent magnet may be prohibited when the actuator is located in high temperature (e.g., T>650° C.) environments.

BRIEF DESCRIPTION OF THE INVENTION

According to one aspect of the invention an electromagnetic actuator is disclosed. The actuator also includes a magnetic circuit including: a stationary core having a first leg, a second leg and a connecting leg that connects the first and second legs, the stationary core being formed of a high temperature ferromagnetic material; and an armature formed of the high temperature ferromagnetic material. The actuator also includes one or more position returning members disposed between the stationary core and the armature; and a first winding surrounding the first leg, the first winding being formed a metal wire with ceramic insulation.

According to another aspect a method of forming an electromagnetic actuator is disclosed. The method includes: providing a magnetic circuit that includes: a stationary core having a first leg, a second leg and a connecting leg that connects the first and second legs, the stationary core being formed of a high temperature ferromagnetic material; and an armature formed of the high temperature ferromagnetic material. The method also includes: disposing one or more position returning members between the stationary core and the armature; and surrounding the first leg with a first winding, the first winding being formed a metal wire with ceramic insulation.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
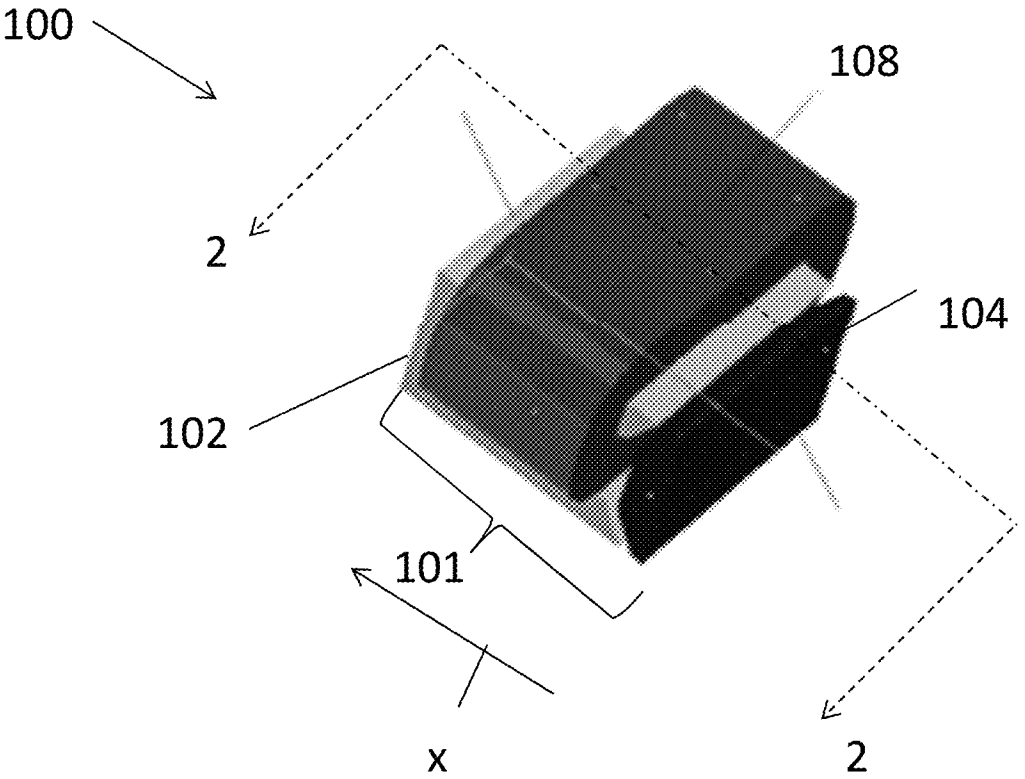
FIG. 1 is a perspective view of an actuator according to one embodiment.

Shown in FIG. 1 is a perspective view of an electromagnetic actuator 100 according to one embodiment. The actuator 100 includes magnetic circuit 101 comprised of a stationary core 102 and a moveable armature 104. The actuator also includes one or more windings (collectively, 108) surrounding one arm of the stationary core 102. Of course, the winding 108 could be a single winding one embodiment. Application of a current to the winding 108 will cause the armature 104 to move closer to the stationary core 102. The current can be pulsed or constant direct current (DC).

In one embodiment, the electro-magnetic actuator 100 may be operable in high temperature environments (e.g., T>650° C.). Applications include, but are not limited to a More Electric Engine (MEE) of aircraft or a controlling a linear motion sliding valve for air distribution control system.

The magnetic circuit 101 can be made of a high temperature soft ferromagnetic material and the winding 108 can be wound from a high temperature conductor with ceramic or mica insulation coating. The magnetic circuit 101 is, in one embodiment, formed of a material having a magnetic permeability much greater than one at high operating temperatures. One example is a cobalt alloy as it does not lose permeability as operating temperatures exceed 650° C. A specific example of such a material includes a Fe—Co—V alloy.

Specifically, the relative magnetic permeability of cobalt alloys change with the magnetic flux density B and temperature $\upsilon$ according to the following expression:

$$\mu_r(B,\upsilon)\approx\mu_r(B)-\alpha(\upsilon-\theta_0)$$

where $\mu_r(B)$ is the variation of the relative magnetic permeability with B, a is a constant and $\theta_0$ is the temperature at which $\mu_r(B)$ curve has been measured. For the winding 108, nickel clad copper, nickel clad silver or aluminum clad copper may be used as high temperature conductors. The variation of electrical conductivity with temperature for a metallic conductor is described as:

$$\alpha(\upsilon)=\frac{\sigma_{20}}{1+\alpha(\upsilon-20)+\beta(\upsilon-20)^2+\gamma(\upsilon-20)^2}\,\text{S/m}$$

where $\alpha$, $\beta$ and $\gamma$ are temperature coefficients depending on the material, $\sigma 20$ is the conductivity at 20° C. and $\sigma(\upsilon)$ is the conductivity at $\upsilon$° C. Ceramic coated wires are capable of operating at high temperatures. Examples of some suitable coatings that may raise the operating temperature to above 650° C. include, but are not limited to, a refractory glass metal compound and AlSi compounds consisting of alumina and silicon dioxide.

Figure 2:
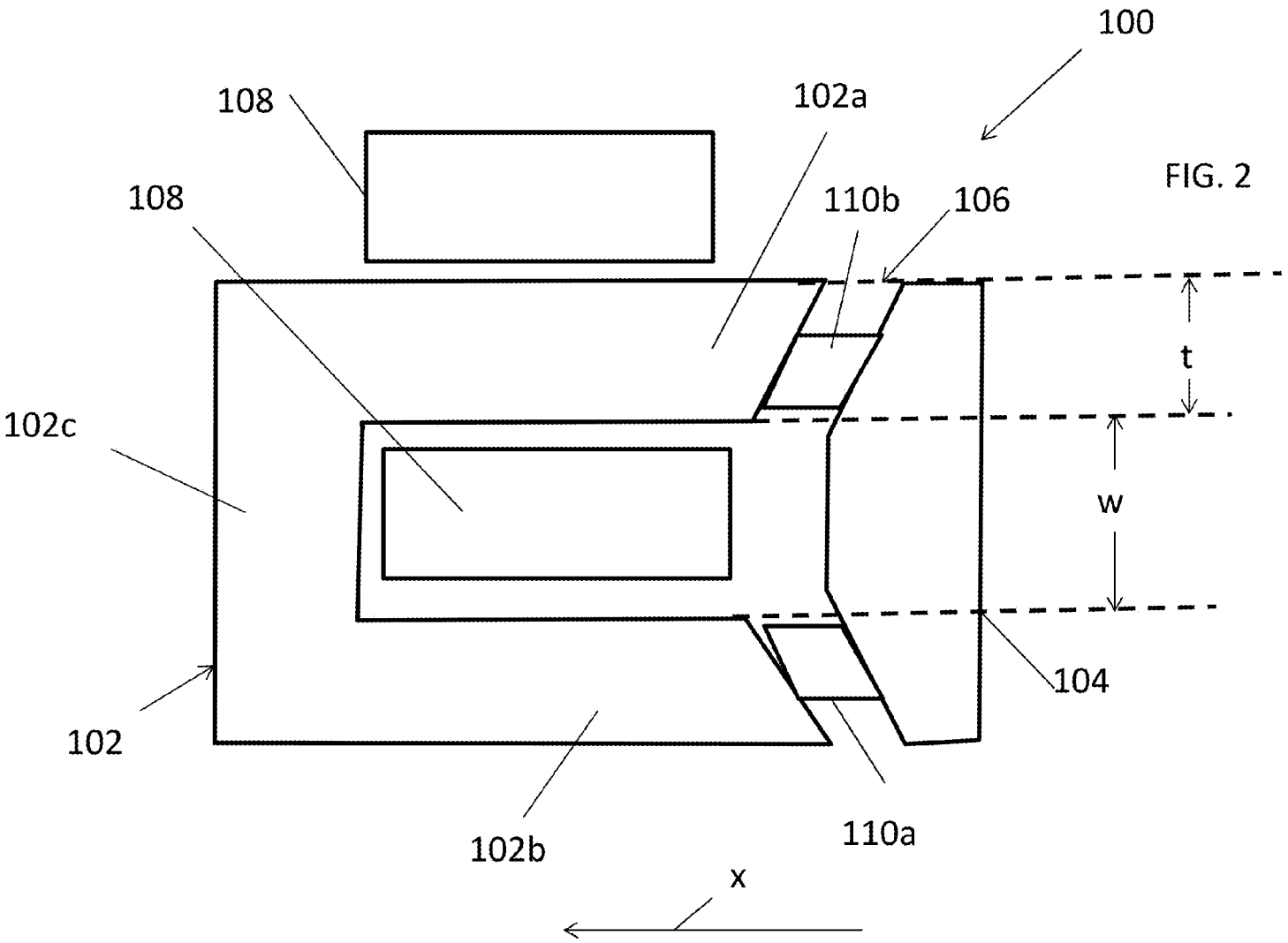
FIG. 2 shows a cross-section of an actuator according to one embodiment.

FIG. 2 shows a cross-section of the actuator 100 of FIG. 1 taken along line 2-2. As discussed above, the actuator 100 includes magnetic circuit 101 comprised of a stationary core 102 and a moveable armature 104. The actuator also includes one or more windings (collectively, 108) surrounding one arm of the stationary core 102. Application of a current to the winding 108 will cause the armature 104 to move closer to the stationary core 102. The current can be pulsed or constant direct current (DC).

The actuator 100 also includes one or more position returning members (such a springs) 110*a*, 110*b* disposed external to the gap such that they maintain gap 106 between the stationary core 102 and the armature 104. As discussed above, application of a current to the winding 108 cause the armature 104 to be attracted to the stationary core 102 and make gap 106 smaller (i.e., it moves from an initial position to another position in direction x). The position returning members 110*a*, 110*b* serve to return the armature 104 to an initial position after the application of a current to the winding 108 ceases. The position returning members 110 may be formed of any non-ferromagnetic material that changes its shape in response to an external force, returning to its original shape when the force is removed. Such materials include steel, steel alloys, stainless steels, chrome vanadium, hastelloy, inconel, phosphor bronze, or beryllium copper.

Figure 3:
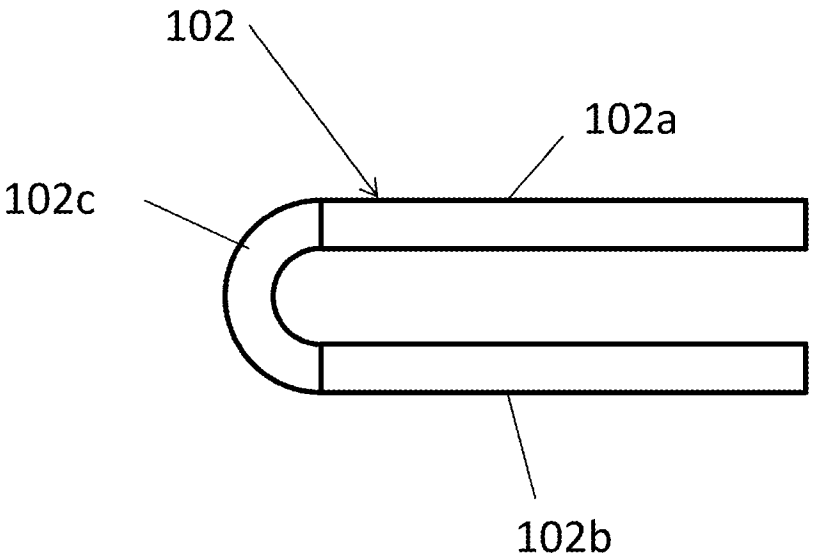
FIG. 3 shows a side of an alternative embodiment of a stationary core.

As illustrated, the stationary core 102 is u-shaped and includes upper and lower legs 102*a*, 102*b* that are connected by cross member 102*c*. In the illustrated embodiment, the winding 108 is wrapped only around the upper leg 102*a*. In another embodiment the winding 108 could be wrapped only around the lower leg 102*b*. Further, the exact shape of the stationary core 102 could be altered. For example, instead of being flat, the cross member 102*c* could be curved as shown in FIG. 3.

In one embodiment, the distance (w) between the upper and lower arms 102*a*, 102*b*, is greater than a thickness (t) of the arms 102*a*, 102*b*, 102*c*. This may reduce leakage as is allows for the space to insulate the windings.

Figure 4:
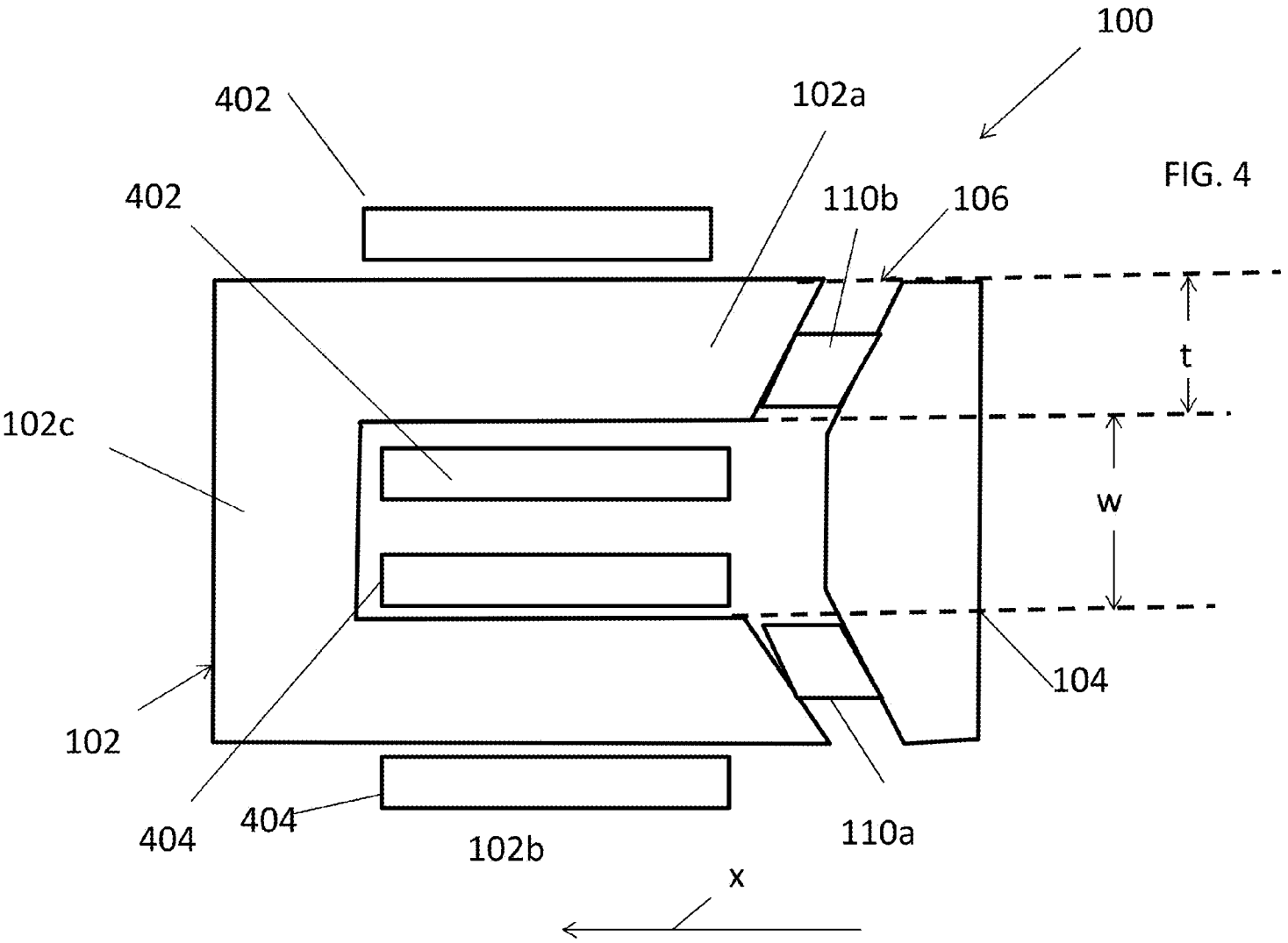
FIG. 4 shows a cross-section of an actuator according to another embodiment.

FIG. 4 shows an alternative embodiment. In this embodiment, two separate windings 402, 404 are provided. The windings 402, 404 are, respectively, wrapped around upper and lower arms 102*a* and 102*b*.

In both the embodiments of FIGS. 2 and 4, the resting position of the armature 104 may be about 1 mm. In such an embodiment, the gap 106 may vary from 0 to 1 mm. Of course, the gap can be any distance and is not limited and depends on the number of Aturns. Application of a current to the windings (108 or 402/404) caused the armature 104 to move closer to the stationary core 102. In alternative embodiments, the armature 104 may remain stationary and the stationary core 102 is allowed to move.

Figure 5:
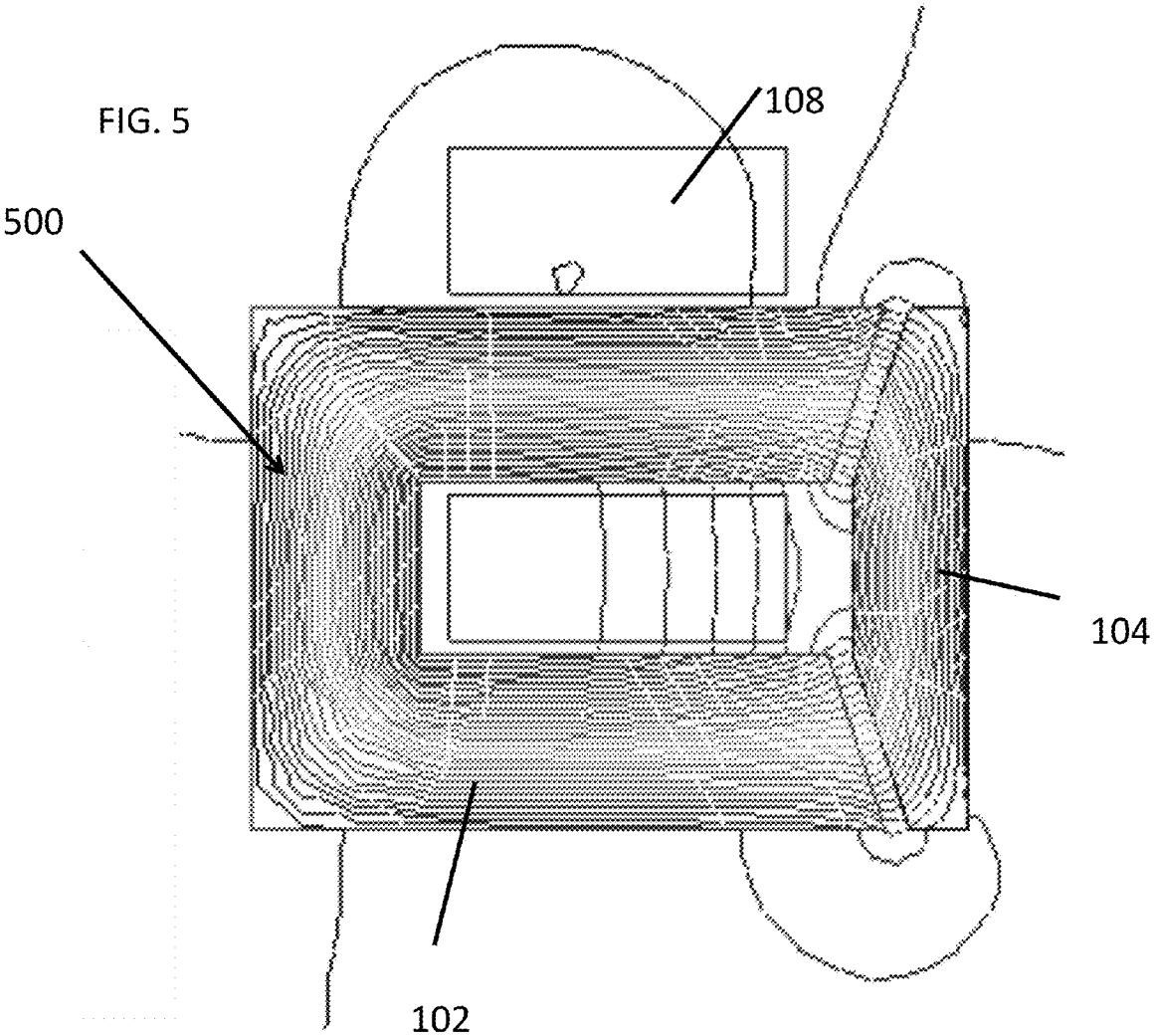
FIG. 5 shows flux lines that may exist according to one embodiment.

FIG. 5 shows an example of flux lines 500 that may exist when a current is applied to the actuator shown in FIG. 3. The flux lines 500 shown in FIG. 5 come from a finite element simulation where the external dimensions of the stationary core 104 with armature are 20×12×20 mm. The cross section of the stationary core 102 is 60 $mm^2$ and magnetic flux density in the core 102 is about $B_{Fe} \approx 1.07$ T at 650° C. The leakage flux is about 5% of the total magnetic flux. Of course, the actual dimensions could vary and those above could be actual dimensions in one embodiment. In this simulation, the mass of the actuator components, force density, and selected electrical and mechanical parameters are shown in Table 1 for a 50-N actuator.

TABLE 1

| | |
|---|---|
| Mass of core, kg | 0.017 |
| Mass of armature, kg | 0.006 |
| Mass of winding with insulation, kg | 0.013 |
| Mass of electromagnet, kg | 0.031 |
| Volume of core, $m^3$ | $0.456 \times 10^{-5}$ |
| Force density, N/kg. | $0.162 \times 10^{4}$ |
| Force density per core volume, $N/m^3$ | $0.110 \times 10^{8}$ |
| Conductivity of wire at 650° C., S/m | $0.164 \times 10^{8}$ |
| Winding inductance, mH | 0.2406 |
| Required spring constant, N/m | $0.5 \times 10^{5}$ |
| Electrical time constant, s | $0.1146 \times 10^{-3}$ |
| Mechanical time constant, s | $0.2524 \times 10^{-5}$ |

Disclosed above is high temperature actuator. Normally, electrical machines and actuators are rated at temperatures not exceeding 155° C. (220° C. for special applications). High temperature (T>650° C.) electromagnetic actuators formed in the manner disclosed above may provide for actuators that can be made with "off-the shelf" high temperature ferromagnetic materials (e.g., Carpenter® Hiperco Fe—Co—V Alloys) and nickel clad copper wire with ceramic insulation capable of operating at minimum 850° C. The such actuators may provide force density over 1500 N/kg for 50-N actuators (Table 1). The actuator may be a simple construction that includes and consist of only the magnetic circuit, winding (FIG. 2) or windings (FIG. 4) and position returning members (e.g., planar suspension springs). Embodiments may provide good dynamic performance with low electrical (<0.00025 s) and mechanical (<0.000015 s) time constant and do not require continuous current (duration of the pulse current in the coil of 50-N actuator is less than 0.005 s). Further, as there are few parts, assembly may be simple.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An electromagnetic actuator comprising:

a magnetic circuit including:

a stationary core having a first leg, a second leg and a connecting leg that connects the first and second legs, the stationary core being formed of a high temperature ferromagnetic material; and an armature formed of the high temperature ferromagnetic material;

one or more position returning members disposed between the stationary core and the armature; and a first winding surrounding the first leg, the first winding being formed a metal wire with ceramic insulation.

2. The electromagnetic actuator of claim 1, wherein the high temperature ferromagnetic material is an Fe—Co—V alloy or another cobalt alloy.

3. The electromagnetic actuator of claim 1, wherein the metal wire is formed of nickel coated copper with ceramic insulation.

4. The electromagnetic actuator of claim 1, wherein the position returning members are planer suspension springs.

5. The electromagnetic actuator of claim 4, wherein the planer suspension springs are formed of steel, steel alloys, stainless steels, chrome vanadium, hastelloy, inconel, phosphor bronze, or beryllium copper.

6. The electromagnetic actuator of claim 1, wherein the position returning members are formed of steel, steel alloys, stainless steels, chrome vanadium, hastelloy, inconel, phosphor bronze, or beryllium copper.

7. The electromagnetic actuator of claim 1, further comprising:

a second winding surrounding the second leg of the stationary core.

8. A method of forming an electromagnetic actuator comprising:

providing a magnetic circuit that includes including:

a stationary core having a first leg, a second leg and a connecting leg that connects the first and second legs, the stationary core being formed of a high temperature ferromagnetic material; and an armature formed of the high temperature ferromagnetic material;

disposing one or more position returning members between the stationary core and the armature; and surrounding the first leg with a first winding, the first winding being formed a metal wire with ceramic insulation.

9. A method of forming an electromagnetic actuator of claim 8, wherein the high temperature ferromagnetic material is an Fe—Co—V alloy or another cobalt alloy.

10. A method of forming an electromagnetic actuator of claim 8, wherein the metal wire is formed of nickel coated copper with ceramic insulation.

11. A method of forming an electromagnetic actuator of claim 8, wherein the position returning members are planer suspension springs.

12. A method of forming an electromagnetic actuator of claim 11, wherein the planer suspension springs are formed of steel, steel alloys, stainless steels, chrome vanadium, hastelloy, inconel, phosphor bronze, or beryllium copper.

13. A method of forming an electromagnetic actuator claim 8, wherein the position returning members are formed of steel, steel alloys, stainless steels, chrome vanadium, hastelloy, inconel, phosphor bronze, or beryllium copper.

14. A method of forming an electromagnetic actuator claim 8, further comprising:

a second winding surrounding the second leg of the stationary core.

* * * * *